US011697191B2

(12) United States Patent
Grimes

(10) Patent No.: US 11,697,191 B2
(45) Date of Patent: Jul. 11, 2023

(54) OFFSET ADJUSTABLE WRENCH

(71) Applicant: ALLIED RUBBER & GASKET CO., INC., Carlsbad, CA (US)

(72) Inventor: Jim Grimes, Carlsbad, CA (US)

(73) Assignee: ALLIED RUBBER & GASKET CO., INC., Carlsbad, CA (US)

( * ) Notice: Subject to any disclaimer, the term of this patent is extended or adjusted under 35 U.S.C. 154(b) by 242 days.

(21) Appl. No.: 17/039,811

(22) Filed: Sep. 30, 2020

(65) Prior Publication Data

US 2021/0094153 A1 Apr. 1, 2021

Related U.S. Application Data

(60) Provisional application No. 62/908,834, filed on Oct. 1, 2019.

(51) Int. Cl.
*B25B 13/16* (2006.01)
*B25B 23/16* (2006.01)

(52) U.S. Cl.
CPC ..... *B25B 13/16* (2013.01); *B25B 23/16* (2013.01)

(58) Field of Classification Search
CPC ..... B25B 13/10; B25B 13/102; B25B 13/12; B25B 13/14; B25B 13/16; B25B 13/18; B25B 13/481; B25B 23/16; B25B 7/10; B25B 7/02; B25F 1/003
See application file for complete search history.

(56) References Cited

U.S. PATENT DOCUMENTS

| | | | | |
|---|---|---|---|---|
| 716,197 | A | 12/1902 | Dauer | |
| 1,061,339 | A | 5/1913 | Thomson | |
| 1,123,423 | A | 1/1915 | Thomson | |
| 1,133,236 | A | 3/1915 | Peterson | |
| 1,402,686 | A * | 1/1922 | Trabold | B25B 13/14 81/157 |
| 1,512,559 | A | 10/1924 | Moore | |
| 1,530,860 | A | 3/1925 | Spanovic | |
| 1,805,298 | A * | 5/1931 | Schweigert | B25B 13/14 81/177.8 |

(Continued)

FOREIGN PATENT DOCUMENTS

| | | |
|---|---|---|
| DE | 9319522 | 2/1994 |
| FR | 689118 | 9/1930 |

OTHER PUBLICATIONS

"Husky Adjustable Plumbers Wrench", Home Depot, https://www.homedepot.com/p/Husky-Adjustable-Plumbers-Wrench-16PL0134/304217578, retrieved on Oct. 29, 2020.

(Continued)

*Primary Examiner* — Robert J Scruggs
(74) *Attorney, Agent, or Firm* — Knobbe, Martens, Olson & Bear, LLP

(57) ABSTRACT

Various offset adjustable wrenches and methods are disclosed herein. The offset adjustable wrench has first and second jaws. The second jaw can be moved relative to the first jaw to grip objects of various sizes. The second jaw can be connected to a sliding element that can reduce or eliminate wobble of the second jaw to improve grip strength. The first and second jaws can be offset from a handle such that a user can grip and rotate an object with the offset adjustable wrench without injuring the user's hand contacting an adjacent surface, such as a wall or ceiling.

21 Claims, 8 Drawing Sheets

(56) References Cited

U.S. PATENT DOCUMENTS

| | | | | |
|---|---|---|---|---|
| 2,376,764 | A | 5/1945 | Flower | |
| 2,643,569 | A * | 6/1953 | Barnes | B25B 13/14 76/114 |
| 2,791,143 | A | 5/1957 | Rossi et al. | |
| 2,978,938 | A * | 4/1961 | Nalley | B25G 1/066 81/177.8 |
| 3,710,656 | A | 1/1973 | Casner | |
| 3,766,810 | A | 10/1973 | Romak | |
| 4,477,936 | A | 10/1984 | Weston | |
| D326,037 | S | 5/1992 | Murayama | |
| D352,215 | S | 11/1994 | Starck | |
| 5,595,098 | A | 1/1997 | Malkin et al. | |
| 6,000,301 | A | 12/1999 | Hillinger | |
| 6,016,723 | A | 1/2000 | Hillinger | |
| 6,748,827 | B2 | 6/2004 | Huang | |
| 6,799,493 | B2 * | 10/2004 | Wang | B25B 13/12 81/145 |
| 7,201,084 | B2 | 4/2007 | Yap | |
| 8,850,931 | B1 | 10/2014 | Hebert | |
| 10,081,092 | B2 | 9/2018 | Lazarov | |
| 2008/0196558 | A1 * | 8/2008 | Picone | B25B 13/14 81/170 |

OTHER PUBLICATIONS

"Universal Fire Sprinkler Head Wrench", SKU 3099189, ARGCO, https://argco.com/piping-tools/universal-fire-sprinkler-head-wrench.html, product apparently available before Oct. 1, 2018.

* cited by examiner

OFFSET ADJUSTABLE WRENCH

CROSS REFERENCE

This application claims the priority benefit of U.S. Application No. 62/908,834, filed Oct. 1, 2019, which is hereby incorporated by reference in its entirety. All applications for which a foreign or domestic priority is identified in the Application Data Sheet as filed with the present application are hereby incorporated by reference under 37 CFR 1.57.

FIELD

This disclosure relates to wrenches, such as adjustable wrenches with offset jaws.

SUMMARY OF CERTAIN FEATURES

Wrenches, also sometimes referred to as spanners, can be used to apply torque to an object, such as a nut, bolt, threaded feature, and the like. A wrench can grip an object between its jaws while a user grasps its handle to rotate or inhibit the rotation of the object. Some wrenches have fixed jaws (e.g., a fixed wrench), limiting the wrench to gripping an object of a particular size. A fixed wrench can be inconvenient. For example, the user must have a wrench of the correct size to be able to grip an object, prompting users to bring multiple wrenches of various sizes when unsure about the size of an object. In contrast, some wrenches have an adjustable jaw (e.g., an adjustable wrench), allowing the adjustable jaw to be moved relative to a fixed jaw to grip objects of various sizes. The adjustable jaw, however, can wobble (e.g., jiggle, shake) when the adjustable jaw and fixed jaw are gripping (e.g., clamping, holding) an object therebetween, which can result in a weakened grip on the object. In some aspects, the adjustable jaw can wobble as it is moved relative to the fixed jaw to accommodate gripping objects of different sizes. In some aspects, the adjustable jaw can bind when the user is attempting to move the adjustable jaw relative to the fixed jaw.

Some wrenches, fixed or adjustable, are flat. Stated differently, the handle and jaws are positioned in a common plane. Such an arrangement can be inconvenient when gripping and rotating an object disposed on and/or against an adjacent surface, such as a wall or ceiling. For example, such an arrangement can be inconvenient when gripping and rotating a coupling nut, plumbing stop valve or other fixtures or fasteners, heating ventilation and air conditioning (HVAC) equipment, and pendant fire sprinkler heads disposed on a ceiling. The handle of the wrench rotates proximate (e.g., adjacent) the surface (e.g., the ceiling) leading the user's hand that is gripping the handle to scrape the surface, which can result in injury (e.g., scraping of the user's knuckles). The wrench can be operated while spacing the user's hand away from the adjacent surface.

Various wrenches, including offset adjustable wrenches, and components thereof are disclosed herein that address one or more of the problems detailed above or other problems.

Certain implementations of the offset adjustable wrenches disclosed herein can include an adjustable jaw with reduced wobble during use. For example, the offset adjustable wrench can have reduced wobble when gripping an object, which can result in an improved jaw grip. The offset adjustable wrench can have reduced wobble when moving the adjustable jaw relative to the fixed jaw. In some variants, the offset adjustable wrenches can control adjustable jaw wobble with a sliding element disposed in a chamber, reducing or eliminating the need for expensive post-casting machining to control wobble. The sliding element disposed within the chamber can reduce movement of the adjustable jaw relative to the fixed jaw in a direction other than towards or away from the fixed jaw. Certain implementations of the offset adjustable wrenches disclosed herein can include an adjustable jaw with reduced binding when moving the adjustable jaw relative to the fixed jaw.

Certain implementations of the offset adjustable wrenches disclosed herein include jaws that are offset from the handle thereof. The fixed and adjustable jaws can be oriented on a plane that is offset (e.g., spaced away) from the plane of the handle. Positioning the fixed and adjustable jaws on a plane that is offset from the plane of the handle enables the user to grip an object disposed on, proximate, and/or against a surface with the jaws of the wrench while firmly gripping the handle of the wrench at a position that is offset (e.g., spaced away) from the surface. The offset configuration allows the user's hand to remain spaced away from the surface while firmly grasping the handle and rotating an object, which can reduce injury to the user's knuckles. The offset configuration can allow users to access tight spaces without injuring the user's hands and/or can provide more leverage and/or ease of use—e.g., when working overhead. For example, an offset adjustable wrench in accordance with one or more embodiments described herein can facilitate access to and manipulation of nuts, bolts, and other fasteners in plumbing, HVAC, and other applications in which space is tight. As another example, the offset adjustable wrenches disclosed herein can enable a user to grip and rotate pendant or exposed fire sprinklers of various sizes disposed on a ceiling without scraping the user's knuckles on the ceiling upon which the fire sprinkler is disposed and/or assist the user in providing leverage to rotate the fire sprinkler. A flat wrench could be angled to position the handle thereof away from a surface while gripping an object thereon, but angling the wrench can reduce the gripping power of the jaws (e.g., decrease the contact area of the jaws on the object), which can lead to the jaws slipping off the object and causing injury. Certain implementations of the offset wrench have an advantage over a straight wrench by allowing the user (e.g., a pipe fitter) better leverage, giving extra torque with less effort. This may be especially significant when working overhead.

In some variants, an offset adjustable wrench is disclosed herein. The offset adjustable wrench can have a base with a chamber. The offset adjustable wrench can include a sliding element that can be received in the chamber. The sliding element can have a plurality of cylindrical rails. The offset adjustable wrench can include a first jaw connected with the base. The offset adjustable wrench can have a second jaw connected with the sliding element. The offset adjustable wrench can include a worm gear that can operatively engage with the sliding element such that rotation of the worm gear translates the sliding element relative to the base, thereby translating the first jaw relative to the second jaw.

In some variants, the sliding element can have teeth that can engage with the worm gear.

In some variants, the offset adjustable wrench can include a handle connected to the base. The first jaw and second jaw can be offset from the handle.

In some variants, the offset adjustable wrench can have a handle that can be disposed on a first plane. The first jaw and second jaw can be disposed on a second plane that is offset from the first plane. In some variants, the first plane and second plane can be angled relative to each other. In some variants, the first plane can be at a five degree angle relative to the second plane.

In some variants, the base can extend at an angle between the handle and the first jaw.

In some variants, the base can extend at an angle of 150 degrees between the handle and the first jaw.

In some variants, the plurality of cylindrical rails can include three cylindrical rails.

In some variants, struts can connect adjacent cylindrical rails of the plurality of cylindrical rails.

In some variants, the chamber can include contours corresponding to contours of the sliding element.

In some variants, the second jaw can be limited to 5 mm or less of movement in a direction that is not directly towards or away from the first jaw.

In some variants, an adjustable wrench is disclosed herein. The adjustable wrench can include a base that can have a cavity. The adjustable wrench can have a fixed jaw connected to the base. The adjustable wrench can include a sliding guide that can be received in the cavity. The sliding guide can have rails. The adjustable wrench can include an adjustable jaw that can be connected to the sliding guide. The adjustable wrench can have a worm screw that can engage with the sliding guide such that rotation of the worm screw translates the sliding guide relative to the base, causing the adjustable jaw to be moved relative to the fixed jaw. The adjustable wrench can include a handle that can be grasped by a user. The fixed jaw and the adjustable jaw can be offset from the handle.

In some variants, the fixed jaw and adjustable jaw can be disposed on a plane that can be offset from a plane of the handle.

In some variants, the base can be angled relative to the handle.

In some variants, the base can be angled at 150 degrees relative to the handle.

In some variants, the rails can include three cylindrical rails.

In some variants, the cavity can include three cylindrical slots that can correspond to the three cylindrical rails. The three cylindrical slots can receive the three cylindrical rails, respectively.

In some variants, the cavity can have a periphery that corresponds to a periphery of the sliding guide.

In some variants, an offset adjustable wrench is disclosed herein. The offset adjustable wrench can include a base that has a cavity. The cavity can have three cylindrical slots. The offset adjustable wrench can include a guide that can have three cylindrical rails that can be respectively received in the three cylindrical slots of the cavity. At least one of the three cylindrical rails can have teeth. The offset adjustable wrench can include a fixed jaw connected with the base. The offset adjustable wrench can have an adjustable jaw connected with the guide. The offset adjustable wrench can include a worm gear that can engage with the teeth of the one of the three cylindrical rails such that rotation of the worm gear translates the guide within the cavity relative to the base to move the adjustable jaw relative to the fixed jaw while maintaining the adjustable jaw opposite the fixed jaw. The offset adjustable wrench can include a handle. The base can extend from the handle at an angle such that the adjustable jaw and fixed jaw are positioned on a plane that is offset from another plane of the handle.

BRIEF DESCRIPTION OF THE DRAWINGS

Various features of the embodiments disclosed herein are described below with reference to the drawings of the embodiments. The illustrated embodiments are intended to illustrate, but not to limit, the scope of protection. Various features of the different disclosed embodiments can be combined to form further embodiments, which are part of this disclosure.

FIG. 1 includes a close-up view of a portion of the wrench. For purposes of presentation, parts of the wrench are illustrated as transparent (in dashed line).

DETAILED DESCRIPTION OF CERTAIN EMBODIMENTS

Illustrative embodiments and examples of offset adjustable wrenches and related methods are described below This disclosure extends beyond the specifically disclosed embodiments and/or uses and obvious modifications and equivalents thereof. Thus, it is intended that the scope of this disclosure should not be limited by any particular embodiments described below.

Figure 1:
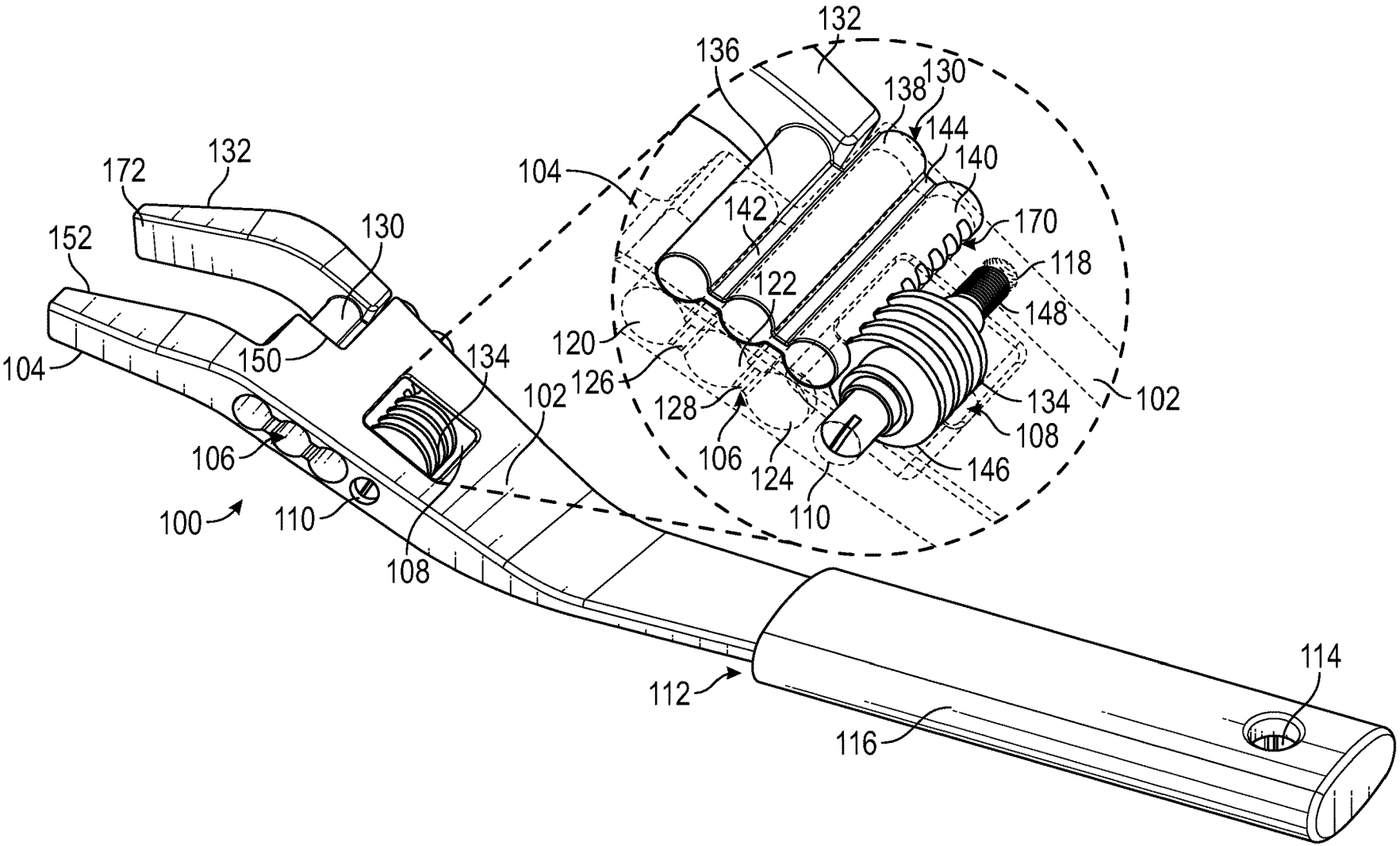
FIG. 1 illustrates an example of an offset adjustable wrench.

FIG. 1 illustrates an example offset adjustable wrench 100. The offset adjustable wrench 100 can be a variety of sizes and lengths. For example, in some aspects, the offset adjustable wrench 100 has a length of about 310 mm. In some aspects, the offset adjustable wrench 100 has a length that is less than or greater than 310 mm. In some aspects, the offset adjustable wrench 100 can be adjustable to accommodate bolt or nut sizes of about ⅝ inch to about 1¼ inch. In some aspects, the offset adjustable wrench 100 can be adjustable between about ¼ inch to about 4 inches or any subset of ranges therebetween.

As described in more detail below, the wrench 100 can include a handle 112, base 102, and jaws 104, 132. As illustrated, the base 102 (also referred to as a shank) can connect the handle 112 to the jaws 104, 132. The base 102 can include a chamber 106, such as a cavity, pocket, void, hole, hollow, gap, opening. The chamber 106 can receive a sliding element 130 (e.g., adjustable element, slide, adjustable slide, contoured slide, guide, contoured guide, sliding guide). This can be seen, for example, in the close-up view portion of FIG. 1, in which, for purposes of presentation, certain portions, such as the base 102, are illustrated as transparent (in dashed line). The chamber 106 can have a shape that corresponds to the sliding element 130. The base 102 can be connected to a first jaw 104 (also referred to as a fixed jaw or immobile jaw), which can be fixed. The sliding element 130 can be connected to a second jaw 132 (also referred to as an adjustable jaw or moveable jaw). The second jaw 132 can be moveable (e.g., translatable) relative to the first jaw 104. For example, the second jaw 132 can be moved towards or away from the first jaw 104 to grip objects of different sizes between the second jaw 132 and the first jaw 104. The second jaw 132 can be opposite the first jaw 104 such that moving the second jaw 132 closer to the first jaw 104 enables the offset adjustable wrench 100 to grip a smaller object compared to spacing the second jaw 132 farther away from the first jaw 104.

The sliding element 130 positioned within the chamber 106 can maintain the second jaw 132 oriented opposite the first jaw 104 as the second jaw 132 is moved relative to the first jaw 104. The sliding element 130 within the chamber 106 can help reduce and/or eliminate wobbling (e.g., shaking, jiggling) of the second jaw 132 when the offset adjustable wrench 100 is gripping an object, which can increase grip strength. The sliding element 130 within the chamber 106 can reduce movement of the second jaw 132 relative to the first jaw 104 in a direction other than towards or away from the first jaw 104. In some aspects, the sliding element 130 translating within the chamber 106 can reduce and/or eliminate binding as the second jaw 132 is moved relative to the first jaw 104.

The sliding element 130 can include a plurality of rails (e.g., sliding rails, guides, barrels, contours). For example, the illustrated embodiment has three rails—a rail 136, rail 138, and rail 140. In some aspects, the plurality of rails can include two, three, four, five, six, or more rails. The rail 136, rail 138, and/or rail 140 can each have a generally cylindrical shape (e.g., cylindrical rails) and/or have a generally circular cross-section. As illustrated, the plurality of rails can form a slide unit, such as a "triple barrel" slide. In some embodiments, the slide unit includes struts, such as the strut 142 and strut 144 described herein. In some aspects, the plurality of rails can be other cross-sectional shapes, such as polygonal (e.g., rectangular, square, pentagonal, hexagonal, octagonal, or otherwise), irregular, elliptical, and/or others.

A strut (e.g., support, cross piece) can extend between adjacent rails. For example, a strut 142 can extend between the rail 136 and rail 138 and/or a strut 144 can extend between the rail 138 and rail 140. The strut 142 and strut 144 can have a reduced thickness compared to the thickness (e.g., diameter) of the rail 136, rail 138, and/or rail 140.

The chamber 106 can include a plurality of receiving areas (e.g., slots, grooves, channels, conduits). The receiving areas can be shaped or otherwise configured to correspond to and/or receive the plurality of rails. For example, the chamber 106 can include a respective receiving area for each of the plurality of rails and/or struts. The plurality of receiving areas can include three receiving areas—a receiving area 120, receiving area 122, and/or receiving area 124. In some aspects, the plurality of receiving areas can include two, three, four, five, six, or more receiving areas. The receiving areas 120, 122, 124 can correspond to the shape of and receive the plurality of rails. For example, the receiving area 120 can correspond to the shape of and receive the rail 136, the receiving area 122 can correspond to the shape of and receive the rail 138, and/or the receiving area 124 can correspond to the shape of and receive the rail 140.

As illustrated, the receiving area 120, receiving area 122, and receiving area 124 can be cylindrical, which corresponds to the shape of the rail 136, rail 138, and rail 140. In some aspects, the periphery of the receiving area 120, receiving area 122, and receiving area 124 can be generally circular. In some aspects, the receiving areas 120, 122, 124 can be other cross-sectional shapes, such as polygonal (e.g., rectangular, square, pentagonal, hexagonal, octagonal, or otherwise), irregular, elliptical and/or others.

A gap (e.g., channel, slot, slit) can extend between adjacent receiving areas 120, 122, 124. For example, the gap 126 can extend between the receiving area 120 and the receiving area 122 and the gap 128 can extend between the receiving area 122 and the receiving area 124. The gaps 124, 126 can correspond to and receive the struts of the sliding element 130. For example, the gap 126 can correspond to and receive the strut 142 and the gap 128 can correspond to and receive the strut 144. The receiving areas 120, 122, 124 and gaps 124, 126 can connect, such as to form a continuous receiving cavity.

The wrench 100 can be configured to facilitate smooth movement (e.g., translation) of the sliding element 130 within the chamber 106. For example, the wrench 100 can enable the second jaw 132 to smoothly move towards or away from the first jaw 104. In several implementations, the wrench 100 maintains a longitudinal axis of the second jaw 132 parallel to a longitudinal axis of the first jaw 104. In some aspects, the geometry of the sliding element 130 and chamber 106 can reduce unintended movement of the second jaw 134 relative to the first jaw 104, such as in a direction that would otherwise position a portion or all of the second jaw 132 not directly opposite the first jaw 104. In some aspects, the geometry of the sliding element 130 and chamber 106 can reduce or eliminate wobble of the second jaw 132 relative to the first jaw 104. Wobble can be, for example, a shaking of the second jaw 132 and/or movement of the second jaw 132 such that the longitudinal axis of the second jaw 132 is non-parallel to the longitudinal axis of the first jaw 104. Wobble can reduce the effectiveness of the wrench 100. In some aspects, the geometry of the sliding element 130 and chamber 106 can reduce or eliminate movement of the second jaw 132 out of the shared plane of the first jaw 104. In some aspects, the geometry of the sliding element 130 and chamber 106 can allow for greater tolerance without expensive precision post machining. In some aspects, the geometry of the sliding element 130 and chamber 106 can be cast and reduce or eliminate wobbling of the second jaw 132 without post-cast machining. In certain variants, the jaws 104, 132 are rigidly, but not fixedly, connected. The rigid connection can still permit the jaw 132 to move in and out to relative the jaw 104 as described herein while inhibiting or preventing wobble.

The offset adjustable wrench 100 can include a mechanism for adjusting the position of the second jaw 132 relative to the first jaw 104. In some embodiments, the adjustment mechanism comprises a worm gear 134 (e.g., worm screw). The worm gear 134 can be rotated by the user (e.g., by the user's thumb) to move (e.g., translate, manipulate) the sliding element 130 and the second jaw 132. The rotation of the worm gear 134 can translate the sliding element 130 relative to the base 102, thereby moving the second jaw 132 relative to the first jaw 104.

The worm gear 134 can engage teeth 170 of the sliding element 130. Rotation of the worm gear 134 can result in translation of the sliding element 130 and second jaw 132. For example, rotation of the worm gear 134 in a first direction can translate the sliding element 130 such that the second jaw 132 moves toward the first jaw 104 and rotation of the worm gear 134 in a second direction can translate the sliding element 130 such that the second jaw 132 moves away from the first jaw 104, while maintaining the second jaw 132 opposite the first jaw 104. The teeth 170 can be disposed on the rail 140, such as on an outer surface and/or a surface of the rail 140 nearest the handle 112. In some embodiments, the teeth are molded, cut, or otherwise formed into the rail 140.

The base 102 can include a cavity 108 (e.g., cavity, pocket, void, hole, hollow, gap, opening) in which the worm gear 134 can be disposed. The cavity 108 can comprise a through hole or a blind hole. The chamber 106 can be connected to the cavity 108 such that the teeth 170 disposed on the rail 140 can extend into the cavity 108 and engage the worm gear 134.

Figure 2A:
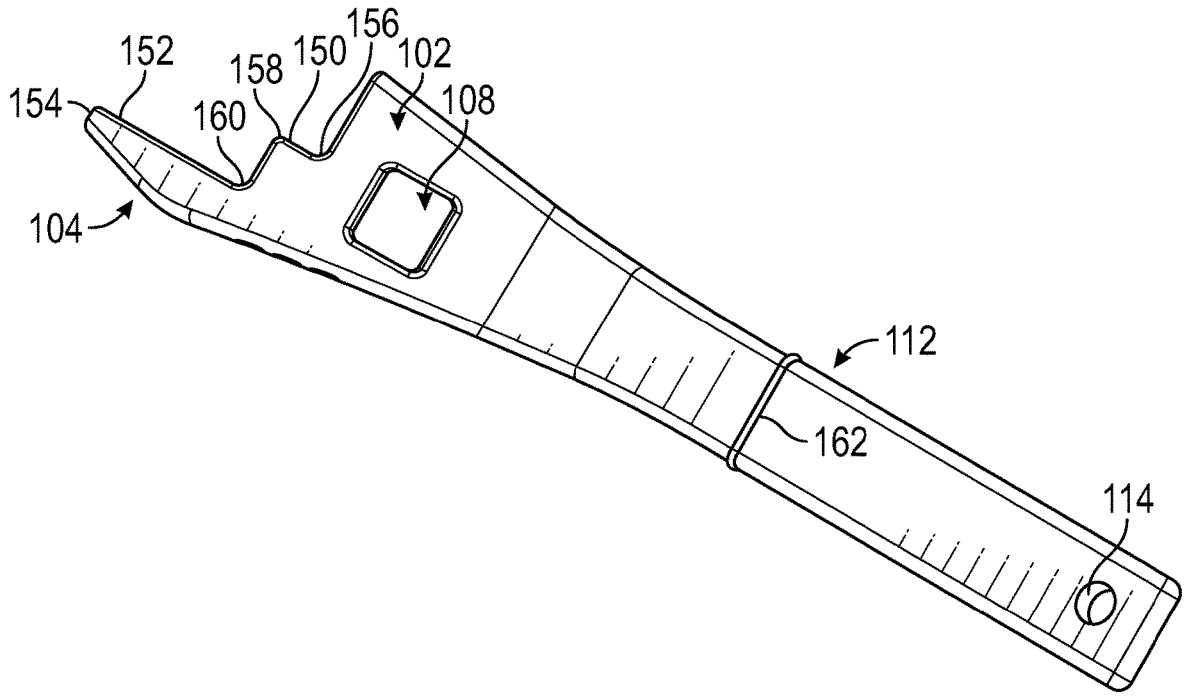
FIG. 2A illustrates a view of a handle, base, and jaw of the offset adjustable wrench illustrated in FIG. 1.

The worm gear 134 can be securely received in the base 102. The base 102 can include a first hole 110 (e.g., aperture, opening) and a second hole 118 (e.g., aperture, opening) to secure the worm gear 134 within the cavity 108. The worm gear 134 can have a first pin 146 (e.g., rod, shaft) that extends into the first hole 110. The worm gear 134 can have a second pin 148 (e.g., rod, shaft) that extends into the second hole 118. The second pin 148 and second hole 118 can be threaded. The first pin 146 can include a slot (e.g., groove, slit) on an end thereof that can be engaged by a tool, such as a flat head screw driver, to screw the second pin 148 into the second hole 118. In some aspects, the worm gear 134 can rotate without rotating the first pin 146 and/or second pin 148. In some aspects, the rotation of the worm gear 134 rotates the first pin 146 and/or second pin 148. The cavity 108 can extend through the base 102. The cavity 108 can have a periphery in the shape of a polygon (e.g., square, rectangle, etc.) and/or other shapes. As illustrated in FIG. 2A, the periphery of the cavity 108 can included rounded corners to avoid injury to the user and/or stress concentrators.

Returning to FIG. 1, the first jaw 104 can include a first engagement surface 152 (e.g., grip surface, clamp surface). The first engagement surface 152 can be positioned opposite the second engagement surface 172 (e.g., grip surface, clamp surface). The first engagement surface 152 and second engagement surface 172 can be used to grip (e.g., clamp, clasp) an object therebetween. The first engagement surface 152 can be oriented to be parallel to the second engagement surface 172. In some aspects, the worm gear 134 can be rotated to translate the sliding element 130 while maintaining the first engagement surface 152 opposite the second engagement surface 172. The geometry of the sliding element 130 and chamber 106 can maintain the first engagement surface 152 opposite the second engagement surface 172 and eliminate or reduce movement of the second engagement surface 172 in a direction other than directly towards or away from the first engagement surface 152.

The base 102 can include a slide stop 150 (e.g., surface, brake, stop, brake surface). The slide stop 150 can be positioned to contact the second jaw 132 to prevent movement toward the first jaw 104. In use, the user can rotate the worm gear 134 in a first direction to translate the sliding element 130 such that the second jaw 132 moves toward the first jaw 104 until contacting the slide stop 150. When the worm gear 134 is rotated in a second direction, the sliding element 130 can be translated such that the second jaw 132 moves away from the first jaw 104, which can be until the worm gear 134 rotates to an end of the teeth 170. In some aspects, the worm gear 134 rotates in the first direction to translate the sliding element 130 such that the second jaw 132 moves toward the first jaw 104 until the worm gear 134 rotates to an end of the teeth 170.

As mentioned above, the offset adjustable wrench 100 can have a handle 112. The handle 112 can be grasped by a user to carry the offset adjustable wrench 100 and/or apply a torque to an object gripped between the first jaw 104 and the second jaw 132. The handle 112 can be covered, at least partially, by a sleeve 116 (e.g., cover, sheath). The sleeve 116 can be made of a material that is comfortable to grip, such as a polymer (e.g., rubber, silicon) and/or other suitable material. The sleeve 116 can be soft. The handle 112, which can include the sleeve 116, can have an aperture 114 (e.g., hole, opening) therethrough. In some aspects, the aperture 114 can be used to store the offset adjustable wrench 100. In some aspects, a rope, string, chain, or the like can be inserted through the aperture 114 to assist in hanging the offset adjustable wrench 100 for storage or securing the offset adjustable wrench 100 to the user. In some aspects, the sleeve 116 can be removed and replaced. The handle 112 can be a variety of lengths. In some aspects, the handle 112 is 6 times or more the length of the first jaw 104. In some aspects, the handle 112 is about 300 mm in length. In some aspects, the handle 112 is less than or greater than 300 mm in length.

The first jaw 104 and second jaw 132 can be positioned at an offset position relative to the handle 112. For example, the handle 112 can be disposed on a first plane while the second jaw 132 and first jaw 104 can be disposed on another plane (e.g., a second plane). The first and second planes can be generally parallel or non-parallel, The offset arrangement can help a user to avoid hand injuries during use, as described herein. The offset arrangement can help a user to apply torque when working overhead, as described herein. The offset arrangement can help a user to rotate the offset adjustable wrench 100 while gripping an object without the handle 112 and/or hand of the user contacting nearby features. The base 102 can be oriented at an angle relative to the handle 112 to space the first jaw 104 and second jaw 132 away from the handle 112. The base 102 can be oriented at varying angles, which can space the first jaw 104 and second jaw 132 at varying distances away from the handle 112. The base 102 can be varying lengths to create more or less distance between the first jaw 104 and second jaw 132 and the handle 112.

FIG. 2A illustrates the handle 112 without the sleeve 116. As illustrated, the handle 112 can include a lip 162 (e.g., raised edge, protrusion). The lip 162 can circumnavigate the handle 112 or only a portion of the handle 112. The lip 162 can impede movement of the second tip 166 in the direction opposite the aperture 114.

The first jaw 104 can have a cross-section that tapers to a first tip 154 (e.g., first end). The first jaw 104 can, in some aspects, have a cross-sectional profile that is largest at a middle portion between the first tip 154 and the base 102. The first tip 154 can have a smaller cross-section that other portions of the first jaw 104 to enable the first jaw 104 to be more easily navigated in tight environments.

The base 102 can include curves to reduce the likelihood of injury to the user and/or stress concentrators. For example, the base 102 can include curve 156, curve 158, and curve 160.

Figure 2B:
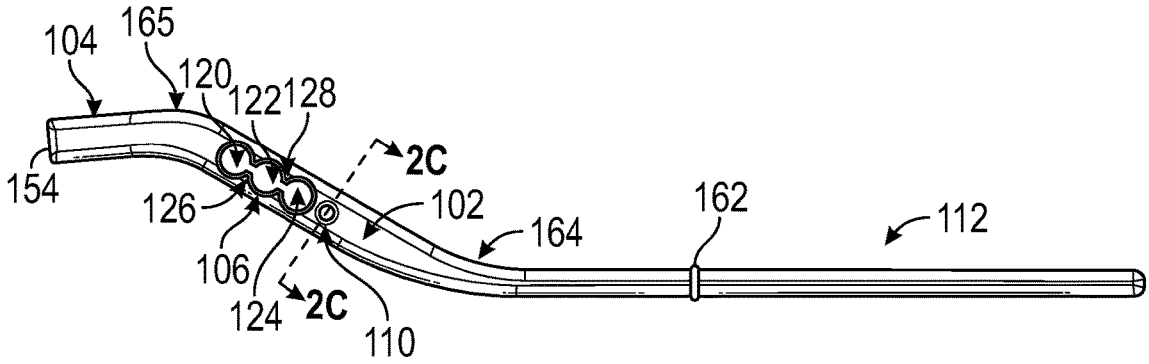
FIG. 2B illustrates a side view of the handle, base, and jaw of FIG. 2A.

As illustrated in FIG. 2B, a curve 164 can define the transition between the handle 112 and base 102. The curve 164 can orient the base 102 at an angle relative to the handle 112, as described elsewhere herein. The curve 164 can reduce or avoid stress concentrators.

A curve 165 can define the transition between the base 102 and first jaw 104 and/or sliding element 130 and the second jaw 132. The curve 165 can orient the first jaw 104 relative to the base 102, which can reduce or avoid stress concentrators. The curve 165 can orient the second jaw 132 relative to the sliding element 130, which can reduce or avoid stress concentrators.

As illustrated in FIG. 2B, centers of the adjacent receiving areas of the chamber 106 can be spaced apart, which can include about 10 mm apart. For example, the center of the receiving area 120 can be spaced 10 mm apart from the center of the receiving area 122 and the center of the receiving area 122 can be spaced 10 mm apart from the center of the receiving area 124. In some aspects, other distances between centers of adjacent receiving areas of the chamber 106 can be used, which can include distances of less or greater than 10 mm. In some aspects, the distances between centers of adjacent receiving areas of chamber 106 can be different from each other. The receiving areas can have diameters of about 8 mm. For example, the receiving area 120, receiving area 122, and receiving area 124 can each have a diameter of about 8 mm. In some aspects, the receiving areas can have diameters and/or sizes that are greater or less than 8 mm.

Figure 2C:
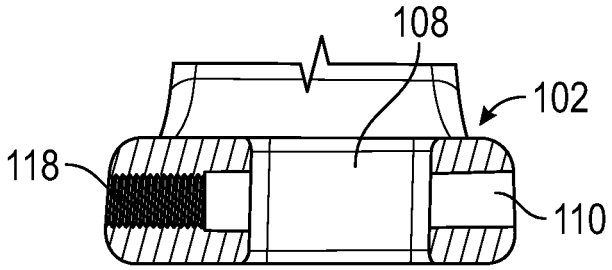
FIG. 2C illustrates a section view of a portion of the base of FIG. 2B.

FIG. 2C illustrates a cross-section of the base 102 along line 2C, as indicated in FIG. 2B. FIG. 2C shows the cavity 108, first hole 110, and second hole 118, as described herein.

Figure 3A:
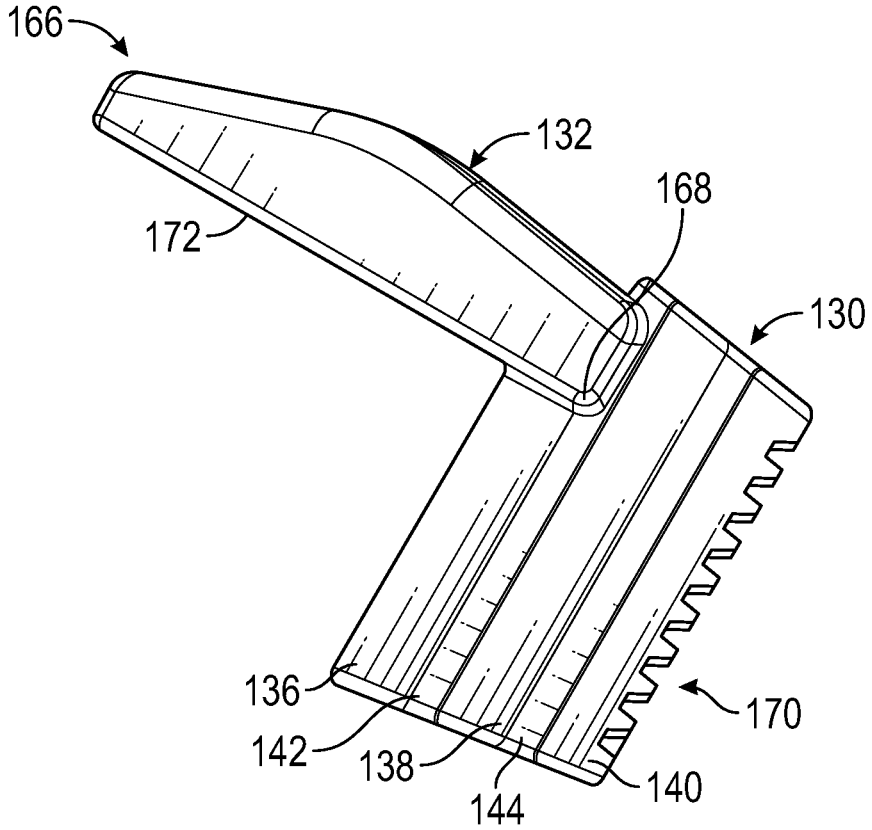
FIG. 3A illustrates the jaw, which is connected to a sliding element, of the offset adjustable wrench of FIG. 1.
Figure 3B:
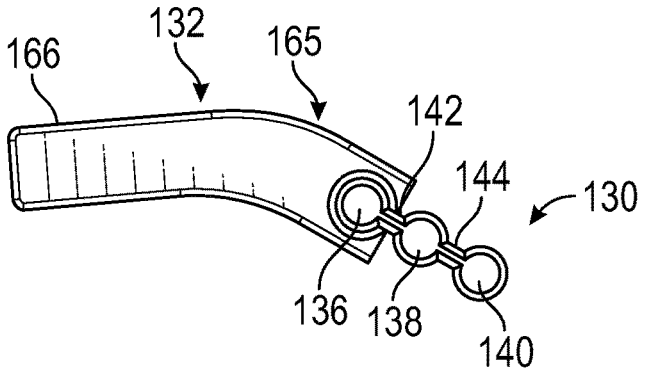
FIG. 3B illustrates a side view of the jaw connected to the sliding element of FIG. 3A.

FIG. 3A illustrates the sliding element 130 with the second jaw 132 connected thereto positioned outside of the chamber 106. The second jaw 132 can have a second tip 166 (e.g., second end). The second jaw 132, in some aspects, can have a cross-section that tapers to the second tip 166. The second jaw 132 can, in some aspects, have a cross-sectional profile that is largest at a middle portion between the second tip 166 and the sliding element 130. The second tip 166 can have a smaller cross-section that other portions of the second jaw 132 to be more easily navigated in tight environments. The sliding element 130 and/or second jaw 132 can include curves to reduce the likelihood of injury and/or stress concentrators For example, a curve 168 can be positioned proximate a junction of the second jaw 132 and sliding element 130.

The geometry and dimensions of the sliding element 130, which can include the size and spacing of the rail 136, rail 138, rail 140, strut 142, and/or strut 144, can correspond to the chamber 106 to enable the sliding element 130 to slide within the chamber 106, as described herein. The centers of the rails of the sliding element 130 can be about 10 mm apart. For example, the center of the rail 136 can be spaced 10 mm apart from the center of the rail 138 and the center of the rail 138 can be spaced 10 mm apart from the center of rail 140. In some aspects, other distances between centers of adjacent rails of the sliding element 130 can be used, which can include distances of less or greater than 10 mm. In some aspects, the distances between centers of adjacent rails of sliding element 130 can be different from each other. The rails can have diameters of less than or equal to about 8 mm. For example, the rail 136, rail 138, and rail 140 can each have a diameter of about 8 mm. The rails, which can include the rail 136, rail 138, and rail 140, can have a diameter that is smaller (e.g., slightly smaller) than the corresponding receiving areas, which can include the receiving area 120, receiving area 122, and receiving area 124. The rails can be slip fit in the receiving areas. In some aspects, the rails can have diameters and/or sizes that are greater or less than 8 mm. The strut 142 and strut 144 can have a thickness of 3 mm. In some aspects, the strut 142 and strut 144 can have a thickness that is greater or less than 3 mm. The struts, which can include the strut 142 and strut 144, can have thickness that are smaller (e.g., slightly smaller), than the corresponding gaps, which can include the gap 126 and gap 128.

Figure 4A:
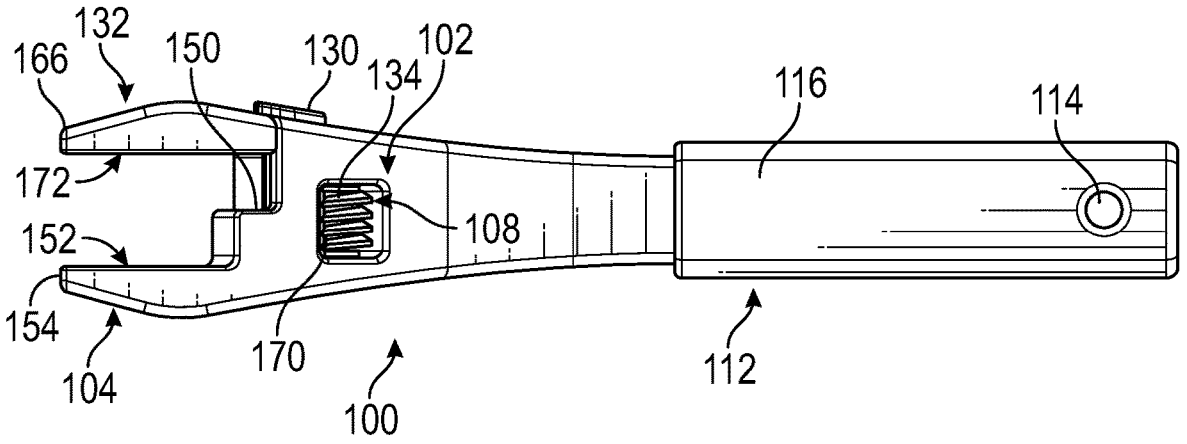
FIG. 4A illustrates a top view of the offset adjustable wrench of FIG. 1.

FIGS. 4A-4F illustrate varying views of the offset adjustable wrench 100 with the sliding element 130 disposed in the chamber 106. As shown in FIG. 4A, the second engagement surface 172 of the second jaw 132 is oriented opposite the first engagement surface 152 of the first jaw 104, which can facilitate securely gripping objects. As described herein, the second engagement surface 172 can be advanced via the rotation of the worm gear 134 until contacting the slide stop 150. In some aspects, the second engagement surface 172 can be advanced until contacting the first engagement surface 152.

Figure 4B:
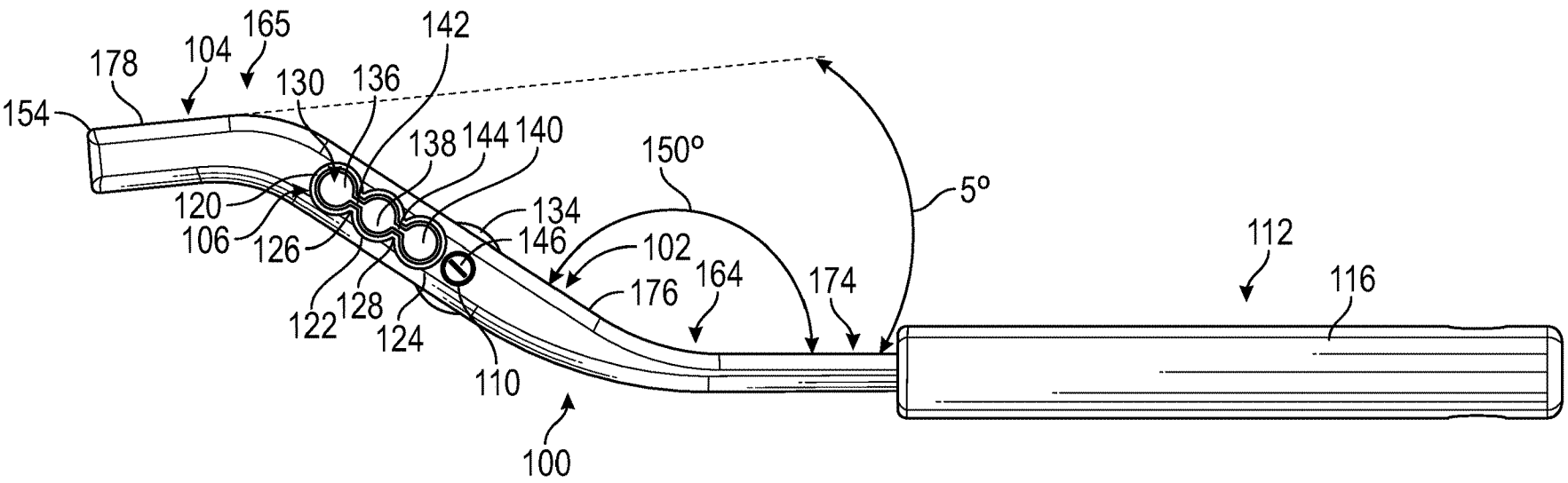
FIG. 4B illustrates a left side view of the offset adjustable wrench of FIG. 1.

FIG. 4B illustrates dimensions that are exemplary and should not be considered limiting. As illustrated, the base 102 can be oriented at about a 150 degree angle relative to the handle 112. In some aspects, the base surface 176 can be oriented at about a 150 degree angle relative to the handle surface 174. In some aspects, the central longitudinal plane of the base 102 can be oriented at about a 150 degree angle relative to the central longitudinal plane of the handle 112. In some aspects, the base 102 can be oriented at angles less than or greater than 150, which can include at least about 120 to about 170 degrees relative to the handle 112.

The first jaw 104 and second jaw 132 can be angled relative to the handle 112. For example, as illustrated, the first jaw 104 and second jaw 132 can be abled at about 5 degrees relative to the handle 112. In some aspects, a first surface 178 of the first jaw 104 and/or a corresponding surface of the second jaw 132 can be angled at about 5 degrees relative to the handle surface 174. In some aspects, the first jaw 104 and second jaw 132 can be angled relative to the handle 112 at angles that are less than or greater than 5 degrees, which can at least include 0-20 degrees. In some variants, the first jaw 104 and second jaw 132 are not angled relative to the handle 112, which can include being disposed on a plane that is parallel to the plane of the handle 112. The orientation of the first jaw 104 and second jaw 132 relative to the handle 112, as described herein, can enable a user to comfortably apply a torque to an object while maintaining a secure grip on the object.

Figure 4C:
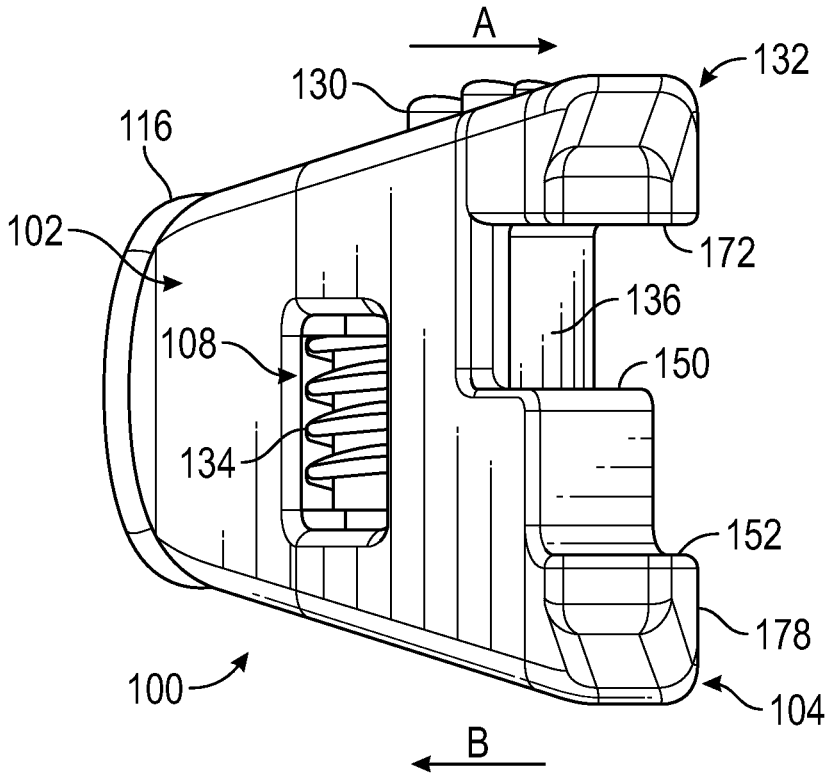
FIG. 4C illustrates a front view of the offset adjustable wrench of FIG. 1.
Figure 4D:
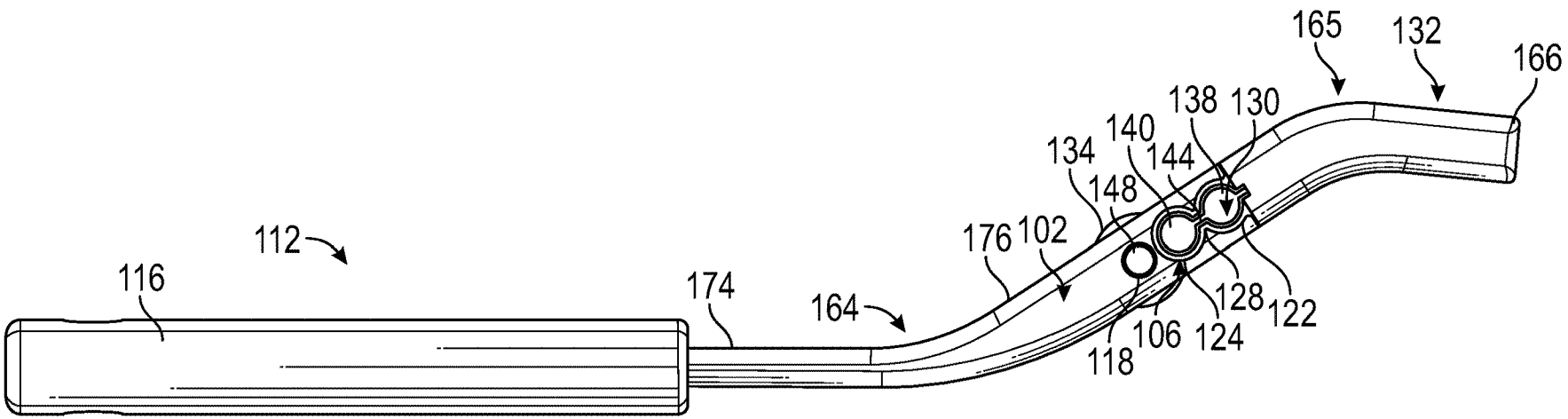
FIG. 4D illustrates a right side view of the offset adjustable wrench of FIG. 1.
Figure 4E:
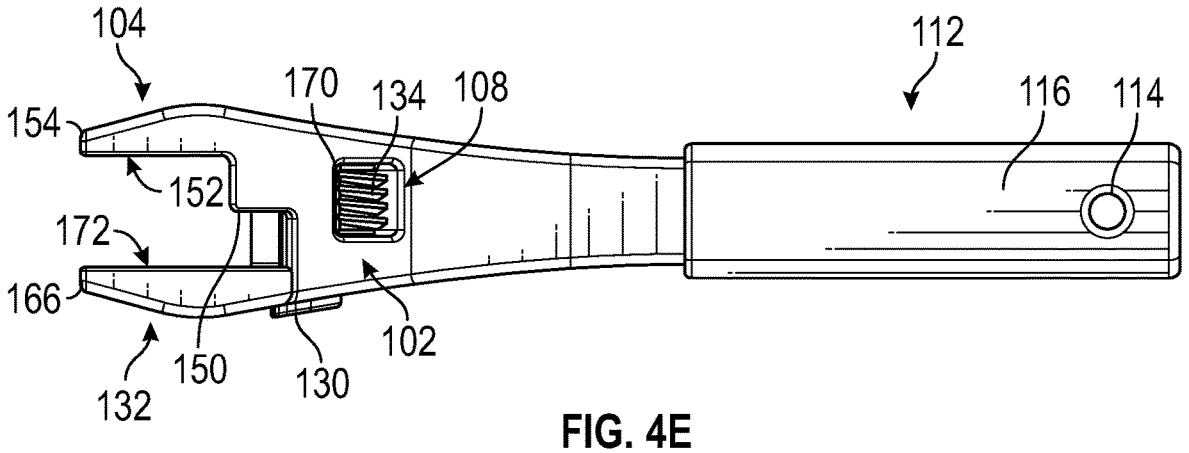
FIG. 4E illustrates a bottom view of the offset adjustable wrench of FIG. 1.
Figure 4F:
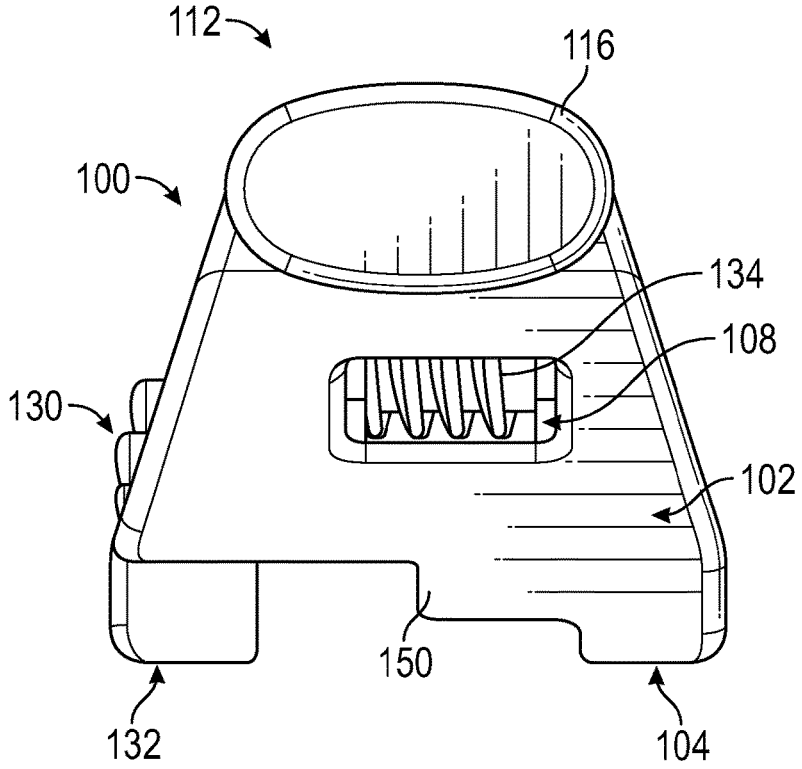
FIG. 4F illustrates a rear view of the offset adjustable wrench of FIG. 1.

The sliding element 130 disposed within the chamber 106 can limit the movement of the second jaw 132 in the direction of arrow A and/or in the direction of arrow B, as illustrated in FIG. 4C. In some aspects, the sliding element 130 and chamber 106 can limit the movement of the second jaw 132 in a direction that does not maintain the second engagement surface 172 opposite (e.g., offset from) the first engagement surface 152. In some aspects, sliding element 130 and chamber 106 can limit the wobble (e.g., jaw wobble) of the second jaw 132 relative to the first jaw 104, which can include movement of the second jaw 132 in the direction of arrow A and/or arrow B. The movement of the second jaw 132 in the direction of arrow A and/or arrow B can be limited to a 0.5 mm range. In some aspects, the movement can be limited less or greater than 5 mm. In some aspects, the total runout between a second surface 180 of the second jaw 132, moved in the direction of A with the sliding element 130 still within the chamber 106, and a first surface 178 of the first jaw 104 can be 5 mm or less than 5 mm. The total runout, in some aspects, can be measured by fixing the first surface 178 while moving the second surface 180 in the direction of arrow A and measuring, via an indicator, on the second surface 180 at and/or proximate the second tip 166.

The offset adjustable wrench 100 and the features thereof can be made of a variety of materials, which can include metals (e.g., steel, aluminum, etc.), metal alloys, polymers (e.g., rubber, silicon), ceramics, and/or other materials. The offset adjustable wrench 100 can have a corrosion-resistant coating, such as a durable chrome finish. The offset adjustable wrench 100 and the features thereof can be manufactured via a variety of techniques, such as casting, molding, machining, additive manufacturing (e.g., 3D printing), and/or via other suitable processes. The wrench 100 can be assembled from formed subcomponents. For example, a method of manufacture can include obtaining a multi-barrel rail unit, obtaining a base with a multi-chamber receiving area, and installing (e.g., with a slip fit) the multi-barrel rail unit in the multi-chamber receiving area. The base can be connected to a handle and/or a first jaw. The multi-barrel rail unit can include a second jaw. The multi-barrel rail unit can be slidable within the multi-chamber receiving area, thereby allowing the second jaw to move relative to the first jaw and/or substantially without wobble.

As used herein, terms relating to shapes generally, such as "circular," "cylindrical," "semi-circular," or "semi-cylindrical" or any related or similar terms, are not required to conform strictly to the mathematical definitions of circles or cylinders or other structures, but can encompass structures that are reasonably close approximations. Terms relating to circular shapes as used herein, such as diameter or radius, should be understood not to require perfect circular structures, but rather should be applied to any suitable structure with a cross-sectional region that can be measured from side-to-side.

Conditional language, such as "can," "could," "might," or "may," unless specifically stated otherwise, or otherwise understood within the context as used, is generally intended to convey that certain embodiments include or do not include, certain features, elements, and/or steps. Thus, such conditional language is not generally intended to imply that features, elements, and/or steps are in any way required for one or more embodiments.

Conjunctive language, such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Terms of orientation used herein, such as "top," "bottom," "horizontal," "vertical," "longitudinal," "lateral," and "end" are used in the context of the illustrated embodiment. However, the present disclosure should not be limited to the illustrated orientation. Indeed, other orientations are possible and are within the scope of this disclosure. Terms relating to circular shapes as used herein, such as diameter or radius, should be understood not to require perfect circular structures, but rather should be applied to any suitable structure with a cross-sectional region that can be measured from side-to-side. Terms relating to shapes generally, such as "circular" or "cylindrical" or "semi-circular" or "semi-cylindrical" or any related or similar terms, are not required to conform strictly to the mathematical definitions of circles or cylinders or other structures, but can encompass structures that are reasonably close approximations.

The terms "approximately," "about," and "substantially" as used herein represent an amount close to the stated amount that still performs a desired function or achieves a desired result. For example, in some embodiments, as the context may permit, the terms "approximately", "about", and "substantially" may refer to an amount that is within less than or equal to 10% of the stated amount. The term "generally" as used herein represents a value, amount, or characteristic that predominantly includes or tends toward a particular value, amount, or characteristic. As an example, in certain embodiments, as the context may permit, the term "generally parallel" can refer to something that departs from exactly parallel by less than or equal to 20 degrees.

Although the offset adjustable wrenches, methods of manufacture, and methods of use been disclosed in the context of certain embodiments and examples, the scope of this disclosure extends beyond the specifically disclosed embodiments to other alternative embodiments and/or uses of the embodiments and certain modifications and equivalents thereof. Various features and aspects of the disclosed embodiments can be combined with or substituted for one another in order to form varying modes of the conveyor. The scope of this disclosure should not be limited by the particular disclosed embodiments described herein.

Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as any subcombination or variation of any subcombination.

Moreover, while operations may be depicted in the drawings or described in the specification in a particular order, such operations need not be performed in the particular order shown or in sequential order, and all operations need not be performed, to achieve the desirable results. Other operations that are not depicted or described can be incorporated in the example methods and processes. For example, one or more additional operations can be performed before, after, simultaneously, or between any of the described operations. Further, the operations may be rearranged or reordered in other implementations. Also, the separation of various system components in the implementations described above should not be understood as requiring such separation in all implementations. The described components and systems can generally be integrated together in a single product or packaged into multiple products. Additionally, other implementations are within the scope of this disclosure.

Some embodiments have been described in connection with the accompanying drawings. The figures are drawn to scale where appropriate, but such scale should not be interpreted as limiting, since dimensions and proportions other than what are shown are contemplated and are within the scope of the disclosed invention. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, any methods described herein may be practiced using any device suitable for performing the recited steps.

In summary, various embodiments and examples of wrenches and methods have been disclosed. This disclosure expressly contemplates that various features and aspects of the disclosed embodiments can be combined with, or substituted for, one another. Accordingly, the scope of this disclosure should not be limited by the particular disclosed embodiments and examples described above, but should be determined only by a fair reading of the claims that follow.

The following is claimed:

1. An offset adjustable wrench comprising:

a base comprising a chamber;

a sliding element received in the chamber, the sliding element comprising a plurality of cylindrical rails;

a first jaw connected with the base;

a second jaw comprising a first end and a second end, the first end opposite the first jaw and extending along a longitudinal central plane, the second end connected with the sliding element and offset at a non-zero angle relative to the first end, wherein the longitudinal central plane does not intersect the plurality of cylindrical rails; and a worm gear configured to operatively engage with the sliding element such that rotation of the worm gear translates the sliding element relative to the base, thereby translating the first jaw relative to the second jaw.

2. The offset adjustable wrench of claim 1, wherein the sliding element comprises teeth that are configured to engage with the worm gear.

3. The offset adjustable wrench of claim 1, comprising a handle connected to the base, wherein the first jaw and second jaw are offset from the handle.

4. The offset adjustable wrench of claim 3, wherein the base extends at an angle between the handle and the first jaw.

5. The offset adjustable wrench of claim 3, wherein the base extends at an angle of 150 degrees between the handle and the first jaw.

6. The offset adjustable wrench of claim 1, comprising a handle disposed on a first plane, wherein the first jaw and second jaw are disposed on a second plane that is offset from the first plane.

7. The offset adjustable wrench of claim 6, wherein the first plane and second plane are angled relative to each other.

8. The offset adjustable wrench of claim 7, wherein the first plane is at a five degree angle relative to the second plane.

9. The offset adjustable wrench of claim 1, wherein the plurality of cylindrical rails comprises three cylindrical rails.

10. The offset adjustable wrench of claim 1, wherein a strut connects adjacent cylindrical rails of the plurality of cylindrical rails.

11. The offset adjustable wrench of claim 1, wherein the chamber comprises contours corresponding to contours of the sliding element.

12. The offset adjustable wrench of claim 1, wherein the second jaw is limited to 5 mm or less of movement in a direction that is not directly towards or away from the first jaw.

13. An adjustable wrench comprising:

a base comprising a cavity;

a fixed jaw connected to the base;

a sliding guide configured to be received in the cavity, the sliding guide comprising rails;

an adjustable jaw comprising a first end and a second end, the first end opposite the fixed jaw and extending along a longitudinal central plane, the second end connected to the sliding guide and offset at a non-zero angle relative to the first end, wherein the longitudinal central plane does not intersect the rails;

a worm screw configured to engage with the sliding guide such that rotation of the worm screw translates the sliding guide relative to the base, causing the adjustable jaw to be moved relative to the fixed jaw; and a handle configured to be grasped by a user, wherein the fixed jaw and the adjustable jaw are offset from the handle.

14. The adjustable wrench of claim 13, wherein the fixed jaw and adjustable jaw are disposed on a plane that is offset from a plane of the handle.

15. The adjustable wrench of claim 14, wherein the base is angled relative to the handle.

16. The adjustable wrench of claim 15, wherein the base is angled at 150 degrees relative to the handle.

17. The adjustable wrench of claim 13, wherein the rails comprises three cylindrical rails.

18. The adjustable wrench of claim 17, wherein the cavity comprises three cylindrical slots that correspond to the three cylindrical rails, the three cylindrical slots being configured to receive the three cylindrical rails, respectively.

19. The adjustable wrench of claim 13, wherein the cavity comprises a periphery that corresponds to a periphery of the sliding guide.

20. An offset adjustable wrench comprising:

a base comprising a cavity, the cavity comprising three cylindrical slots;

a guide comprising three cylindrical rails configured to be respectively received in the three cylindrical slots of the cavity, wherein one of the three cylindrical rails comprises teeth;

a fixed jaw connected with the base;

an adjustable jaw comprising a first end and a second end, the first end opposite the fixed jaw and extending along a longitudinal central plane, the second end connected with the guide and offset at a non-zero angle relative to the first end, wherein the longitudinal central plane does not intersect the three cylindrical rails;

a worm gear configured to engage with the teeth of the one of the three cylindrical rails such that rotation of the worm gear translates the guide within the cavity relative to the base to move the adjustable jaw relative to the fixed jaw while maintaining the adjustable jaw opposite the fixed jaw; and a handle, wherein the base extends from the handle at an angle such that the adjustable jaw and fixed jaw are positioned on a plane that is offset from another plane of the handle.

21. An offset adjustable wrench comprising:

a fixed jaw unit comprising:

a base comprising a chamber; and a first jaw;

a movable jaw unit comprising:

a sliding element received in the chamber, the sliding element comprising a plurality of elongate rails, each of the elongate rails having a respective longitudinal axis; and a second jaw having a free end, wherein a plane that passes through the longitudinal axes of the elongate rails does not pass through the free end; and a worm gear configured to operatively engage with the sliding element such that rotation of the worm gear translates the movable jaw unit relative to the fixed jaw unit, thereby translating the movable jaw unit relative to the fixed jaw unit.

* * * * *